US006158612A

United States Patent [19]

Alpert

[11] Patent Number: 6,158,612

[45] Date of Patent: Dec. 12, 2000

[54] HOLDER FOR A CONTAINER

[76] Inventor: Theodore Alpert, c/o Double-Wrap Cup & Container Company, Inc., 728 W. Jackson Blvd. Suite 1002, Chicago, Ill. 60661

[21] Appl. No.: 09/542,947

[22] Filed: Apr. 4, 2000

Related U.S. Application Data

[62] Division of application No. 09/141,368, Aug. 27, 1998.
[60] Provisional application No. 60/056,085, Aug. 27, 1998.

[51] Int. Cl.[7] ..... B65D 25/34
[52] U.S. Cl. ..... 220/739; 220/662; 220/903
[58] Field of Search ..... 220/903, 902, 220/739, 738, 737, 730, 662, 648, 649; 294/31.2, 131, 165; 229/400, 403

[56] References Cited

U.S. PATENT DOCUMENTS 5,269,368 12/1993 Schneider et al. ..... 165/46
5,525,383 6/1996 Witkowski ..... 428/30
5,580,409 12/1996 Andersen et al. .
5,669,553 9/1997 Smith ..... 229/403
5,908,108 6/1999 Svopa ..... 206/223
5,909,821 6/1999 Guridi ..... 220/739

*Primary Examiner*—Stephen Castellano
*Attorney, Agent, or Firm*—Birch, Stewart, Kolasch & Birch, LLP

[57] ABSTRACT

A holder for a container having a sleeve with an inner surface, an outer surface, an upper end and a lower end. The upper end of the sleeve is configured to permit the sleeve to be position on an outer peripheral surface of a container with the inner surface of the sleeve being engaged with an outer peripheral surface of the container. The sleeve is constructed of a insulated, transparent or translucent material to permit a user to comfortably and conveniently hold the outer surface of the sleeve positioned on a container with a hot or cold beverage being disposed therein while permitting indicia printed on an exterior surface of the container to be visible therethrough.

7 Claims, 1 Drawing Sheet

HOLDER FOR A CONTAINER

CROSS-REFERENCE TO RELATED APPLICATION

This application is a divisional application of co-pending Application Ser. No. 09/141,368 filed on Aug. 27, 1998.

The present application claims the priority of the co-pending Provisional Application No. 60/056,085 filed on Aug. 27, 1998. The contents to this Provisional Application are hereby incorporated by reference.

BACKGROUND OF THE INVENTION

1. Field of the Invention

The present invention is directed to a holder for use together with a container to permit an individual to comfortably and conveniently grasp the exterior surface of a hot or a cold beverage container.

2. Description of Background Art

Holders are currently available for paper and insulated containers. Such holders are normally constructed of corrugated cardboard or other opaque material. The conventional holders cover and/or obscure the printing that normally appears on the exterior surface of the paper or insulated container. In addition, some of the available holders are expensive to construct and are difficult for a user to fit together for mounting on the container.

If a corrugated paper sleeve is used together with a container having a cold beverage disposed therein, there is a tendency for the container to sweat thus causing a deterioration of the corrugated paper sleeve. The tendency for a cold container to sweat is contingent on atmospheric conditions and causes the corrugated paper sleeve to be unsuitable for use as an insulating member for such a container.

SUMMARY AND OBJECTS OF THE INVENTION

It is an object of the present invention to provide a holder for a container to permit an individual to conveniently and comfortably grasp the exterior of a hot container without experiencing any discomfort from the hot beverage disposed within the container. In addition, the present invention permits an individual to grasp the exterior surface of a cold container without experiencing any discomfort from the cold beverage disposed within the container.

These and other objects of the present invention are achieved by providing a sleeve of transparent or translucent plastic material such as bubble wrap, plastic foam, insulating foam or any type of plastic material that is suitable for the intended purpose of fitting over the exterior surface of a container to provide an insulating function while permitting any printed indicia on the exterior surface of the container to be visible through the sleeve.

If a hot beverage is disposed within the container, the sleeve acts to insulate the container to permit an individual to comfortably and conveniently grasp the exterior surface of the container. If a cold beverage is disposed within the container, the sleeve acts to insulate the container to permit an individual to comfortably and conveniently grasp the exterior surface of the container. In addition, with regard to a container with a cold beverage being disposed therein, the plastic material on the exterior surface of the container will not deteriorate when exposed to the moist conditions caused by sweating of the container.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
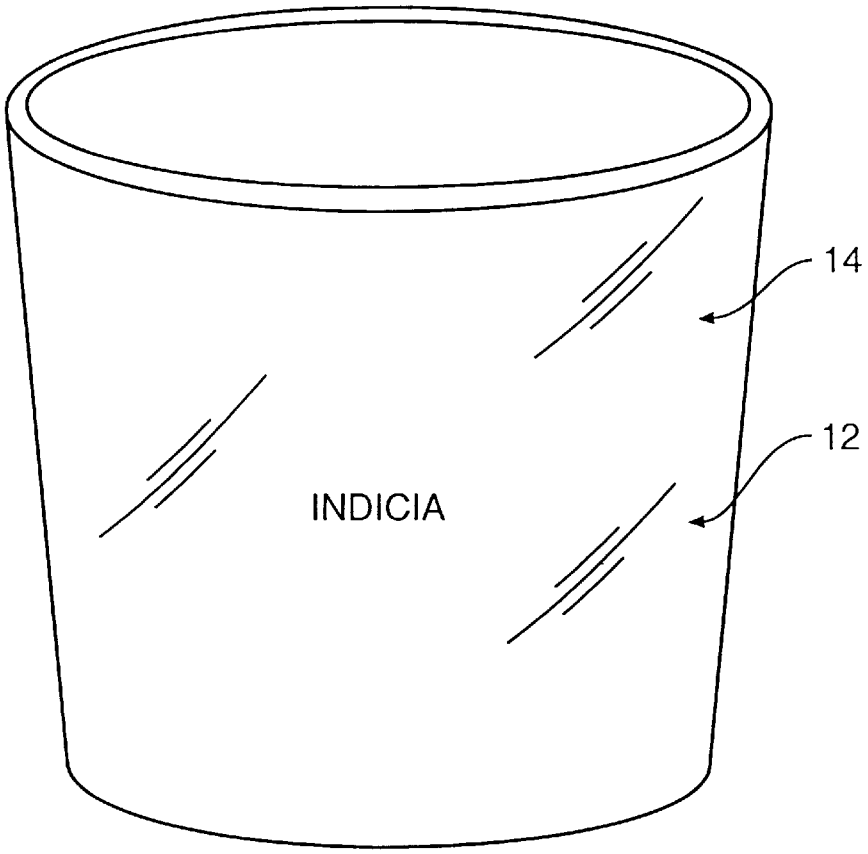
FIG. 1 is a perspective view illustrating a holder according to my invention mounted on a container.

As illustrated in FIG. 1, a holder 12 is mounted on an outer circumferential surface of a paper or insulated container 14. The holder 12 is constructed of a plastic material to provide insulation for the fingers of a consumer as he/she holds the container 14 which is filled with a hot or a cold beverage. The holder 12 is transparent or translucent so that any indicia printed on the exterior surface of the container 14 is visible through the holder 12.

Figure 2:
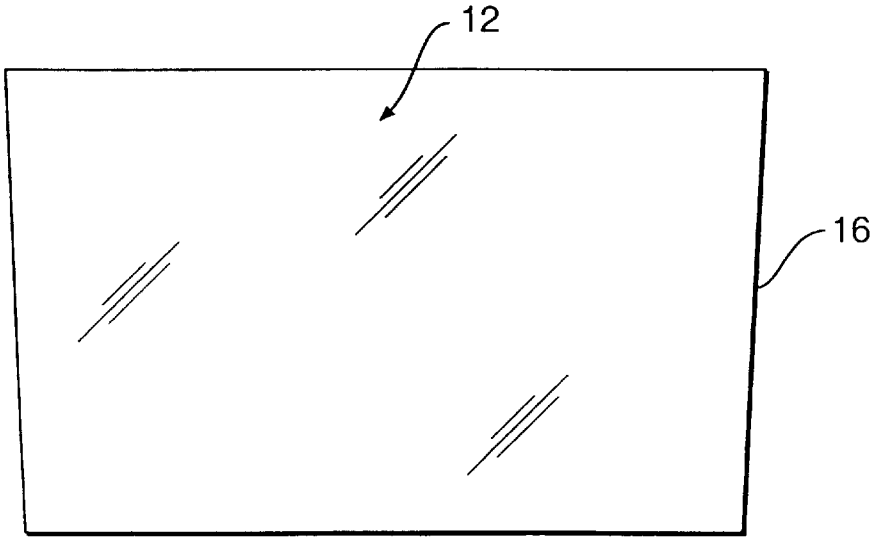
FIG. 2 is a side elevational view of the holder constructed of illustrated in FIG. 1 and being constructed of a transparent or translucent plastic material such as bubble wrap, plastic foam, insulating foam or any type of plastic material that is suitable for the intended purpose of fitting over the exterior surface of a container to provide an insulating function while permitting any printed indicia on the exterior surface of the container to be visible through the sleeve.

A number of various materials may be used for constructing the holder 12. For example, bubble wrap, plastic foam, insulating foam or any type of plastic material that is transparent or translucent while still providing an insulating function may be utilized to permit an individual to very easily slip the holder 12 over the lower end 18 of the container 14. As illustrated in FIG. 2, the holder 12 is formed by heat welding a seam 16 on one side or both sides of the holder 12 to form a one-piece member that does not require any assembly by the user. In addition, it is possible to construct the holder 12 by forming an elongated tube of plastic material and selectively severing the tube in sections to form holders 12 that are in the form of sleeves having a predetermined length. The diameter of the holders 12 is adapted to and determined by the specific volume size and orientation of the container that will be used together with the holder 12.

In operation, an individual would position a holder 12 around the outer peripheral surface of the container 14. Any indicia printed on the container 14 would be visible through the holder 12. The holder 12 would provide insulation to permit a user to easily grasp the container 14 without any discomfort from the hot or cold fluid disposed with the container 14.

The invention being thus described, it will be obvious that the seam may be varied in many ways. Such variations are not to be regarded as a departure from the spirit and scope of the invention, and all such modifications as would be obvious to one skilled in the art are intended to be included within the scope of the following claims.

I claim:

1. A holder for a container comprising:

a frusto conical sleeve having an inner surface, an outer surface, an upper end and a lower end;

said upper end of said frusto conical sleeve being configured to permit said frusto conical sleeve to be position on an outer peripheral surface of a container with the inner surface of said frusto conical sleeve being engaged with an outer peripheral surface of the container;

said frusto conical sleeve being constructed of an insulated, translucent, plastic foam material to permit a user to conveniently hold the outer surface of the frusto conical sleeve positioned on a container containing a hot or cold liquid while permitting indicia printed on a container to be visible therethrough.

2. A holder for use in permitting an individual to comfortably and conveniently grasp a hot or cold container comprising:

a sleeve having an inner surface, an outer surface, an upper end and a lower end;

said upper end of said sleeve having a first predetermined diameter to enable said sleeve to be slipped onto an outer peripheral surface of a container and be snuggly secured adjacent to a corresponding area of a container having a comparable first predetermined diameter;

said lower end of said sleeve having a second predetermined diameter to enable said sleeve to be slipped onto an outer peripheral surface of a container and be snuggly secured adjacent to a corresponding area of a container having a comparable second predetermined diameter;

said sleeve being constructed of an insulated, translucent, plastic foam material to permit a user to conveniently hold the outer surface of the sleeve positioned on a container containing a hot or cold liquid while permitting indicia printed on a container to be visible therethrough.

3. The holder for a container according to claim 2, wherein the first predetermined diameter of the sleeve is greater in diameter relative to the second predetermined diameter.

4. A holder for a container comprising:

a frusto conical sleeve having an inner surface, an outer surface, an upper end and a lower end;

said upper end of said frusto conical sleeve being configured to permit said frusto conical sleeve to be position on an outer peripheral surface of a container with the inner surface of said frusto conical sleeve being engaged with an outer peripheral surface of the container;

said frusto conical sleeve being constructed of an insulated, translucent, bubble wrap material to permit a user to conveniently hold the outer surface of the frusto conical sleeve positioned on a container containing a hot or cold liquid while permitting indicia printed on a container to be visible therethrough.

5. A holder for a container comprising:

a frusto conical sleeve having an inner surface, an outer surface, an upper end and a lower end;

said upper end of said frusto conical sleeve being configured to permit said frusto conical sleeve to be position on an outer peripheral surface of a container with the inner surface of said frusto conical sleeve being engaged with an outer peripheral surface of the container;

said frusto conical sleeve being constructed of an insulated, translucent, foam material to permit a user to conveniently hold the outer surface of the frusto conical sleeve positioned on a container containing a hot or cold liquid while permitting indicia printed on a container to be visible therethrough.

6. A holder for use in permitting an individual to comfortably and conveniently grasp a hot or cold container comprising:

a sleeve having an inner surface, an outer surface, an upper end and a lower end;

said upper end of said sleeve having a first predetermined diameter to enable said sleeve to be slipped onto an outer peripheral surface of a container and be snuggly secured adjacent to a corresponding area of a container having a comparable first predetermined diameter;

said lower end of said sleeve having a second predetermined diameter to enable said sleeve to be slipped onto an outer peripheral surface of a container and be snuggly secured adjacent to a corresponding area of a container having a comparable second predetermined diameter;

said sleeve being constructed of an insulated, translucent, bubble wrap material to permit a user to conveniently hold the outer surface of the sleeve positioned on a container containing a hot or cold liquid while permitting indicia printed on a container to be visible therethrough.

7. A holder for use in permitting an individual to comfortably and conveniently grasp a hot or cold container comprising:

a sleeve having an inner surface, an outer surface, an upper end and a lower end;

said upper end of said sleeve having a first predetermined diameter to enable said sleeve to be slipped onto an outer peripheral surface of a container and be snuggly secured adjacent to a corresponding area of a container having a comparable first predetermined diameter;

said lower end of said sleeve having a second predetermined diameter to enable said sleeve to be slipped onto an outer peripheral surface of a container and be snuggly secured adjacent to a corresponding area of a container having a comparable second predetermined diameter;

said sleeve being constructed of an insulated, translucent, foam material to permit a user to conveniently hold the outer surface of the sleeve positioned on a container containing a hot or cold liquid while permitting indicia printed on a container to be visible therethrough.

* * * * *